US006508516B1

(12) United States Patent
Kammerer

(10) Patent No.: US 6,508,516 B1
(45) Date of Patent: Jan. 21, 2003

(54) TOOL FOR A COAL CUTTING, MINING OR ROAD CUTTING MACHINE

(75) Inventor: Karl Kammerer, Fluorn-Winzeln (DE)

(73) Assignee: Betek Bergbau-Und Hartmetalltechnik Karl-Heinz Simon GmbH & Co. KG, Aichhalden (DE)

( * ) Notice: Subject to any disclaimer, the term of this patent is extended or adjusted under 35 U.S.C. 154(b) by 0 days.

(21) Appl. No.: 09/571,616

(22) Filed: May 15, 2000

(30) Foreign Application Priority Data

May 14, 1999 (DE) ..... 199 22 206

(51) Int. Cl.[7] ..... E21C 25/10; E21B 10/46
(52) U.S. Cl. ..... 299/104; 299/106
(58) Field of Search ..... 299/104, 105, 299/106, 107

(56) References Cited

U.S. PATENT DOCUMENTS 3,856,359 A * 12/1974 Krekeler ..... 299/92
5,415,462 A * 5/1995 Massa ..... 299/86
5,931,542 A * 8/1999 Britzke et al. ..... 299/104

FOREIGN PATENT DOCUMENTS

DE 37 01 905 9/1988

* cited by examiner

*Primary Examiner*—David Bagnell
*Assistant Examiner*—Daniel P Stephenson
(74) *Attorney, Agent, or Firm*—Pauley Petersen Kinne & Erickson

(57) ABSTRACT

A tool for a coal cutting, mining or road cutting machine, having a round-shaft cutter with a cutter head and a cutter shaft. The cutter head rests on a wear-protection disk having an opening. The cutter shaft passes through the opening and the cutter shaft has a clamping element which maintains the round-shaft cutter captively but rotatable around a center longitudinal axis of the receiver, in a receiver of the cutter holder. For a cost-effective fixation of the wear-protection disk against relative rotation, the wear-protective disk has a tab formed on it, which is designed as a holding element and is bent in a direction toward the cutter holder, and which is interlockingly fixed in place in the circumferential direction of the wear-protection disk on a stop of the cutter holder. In one embodiment, the wear-protection disk is fastened on the clamping sleeve.

1 Claim, 2 Drawing Sheets

TOOL FOR A COAL CUTTING, MINING OR ROAD CUTTING MACHINE

BACKGROUND OF THE INVENTION

1. Field of the Invention

This invention relates to a tool for a coal cutting, mining or road cutting machine, having a round-shaft cutter with a cutter head and a cutter shaft, wherein a wear-protection disk is pushed on the cutter shaft, on whose upper side the cutter head rests, wherein the cutter shaft is inserted into a receiver of a cutter holder and is captively held therein, wherein an opposite side of the wear-protection disk is supported on a support surface of the cutter holder, and wherein the wear-protection disk is maintained on the cutter holder, fixed against relative rotation, by at least one holding element.

This invention also relates to a tool for a coal cutting, mining or road cutting machine, having a round-shaft cutter with a cutter head and a cutter shaft, wherein the cutter head rests on a wear-protection disk having an opening, wherein the cutter shaft passes through the opening and wherein the cutter shaft has a clamping element, which maintains the round-shaft cutter captively but rotatable around a center longitudinal axis of the receiver, in a receiver of the cutter holder.

2. Description of Related Art

Such tools are known from German Patent DE 37 01 905.

The round-shaft cutter rotates in the receiver of the cutter holder during operation. During this, the cutter head is dragged over the wear-protection disk. Bores are cut into the support surface of the cutter holder, on which the wear-protection disk rests. Hard alloy pins are inserted into these bores. The bores protrude for some length out of the support surface and dig into an underside of the wear-protection disk.

SUMMARY OF THE INVENTION

It is one object of this invention to provide a tool of the type initially mentioned, wherein the wear-protective disk is fixed against relative rotation in a simple way.

This object of the invention is achieved with a wear-protective disk having a tab formed on it, which is designed as a holding element and is bent in a direction toward the cutter holder, and which is interlockingly fixed in place in a circumferential direction of the wear-protection disk on a stop of the cutter holder.

In this embodiment, the fixation against relative rotation is achieved by means of the tab. The wear-protection disk can be produced in a cost effective manner in one piece with the tab, for example as a punched and bent piece.

In another advantageous embodiment of this invention the receiver is cut into a holding projection of the cutter holder. The holding projection has a protrusion bearing the support surface. The support surface extends out to a radially outwardly located dimension limit of the protrusion. The wear-protection disk covers the entire support surface. Because the wear-protection disk covers the entire support surface, the cutter holder is dependably protected against wear. Thus, advantageously, the protrusion of the holding projection is embodied cylindrically and symmetrically with respect to the center longitudinal axis of the receiver. The protrusion has at least one tangential flattened place forming the stop, against which the tab is resting.

One object of this invention is also achieved by means of a tool which is designed so that the wear-protection disk is fastened on the clamping element. With this tool, the cutter holder essentially remains unaffected when fixed against relative rotation, so that no or only slight adaptation work is required.

In this case, the wear-protection disk is fastened on the clamping element by means of one or several connecting elements. Soldering can be used as the connecting element.

In one embodiment of this invention, the wear-protection disk has an annular shoulder, which is arranged around the opening and extends into the receiver. On a free end the clamping element, which is designed as a clamping sleeve, is connected.

BRIEF DESCRIPTION OF THE DRAWINGS

This invention will be explained in greater detail in what follows by exemplary embodiments represented in the drawings, wherein.

DESCRIPTION OF PREFERRED EMBODIMENTS

Figure 1:
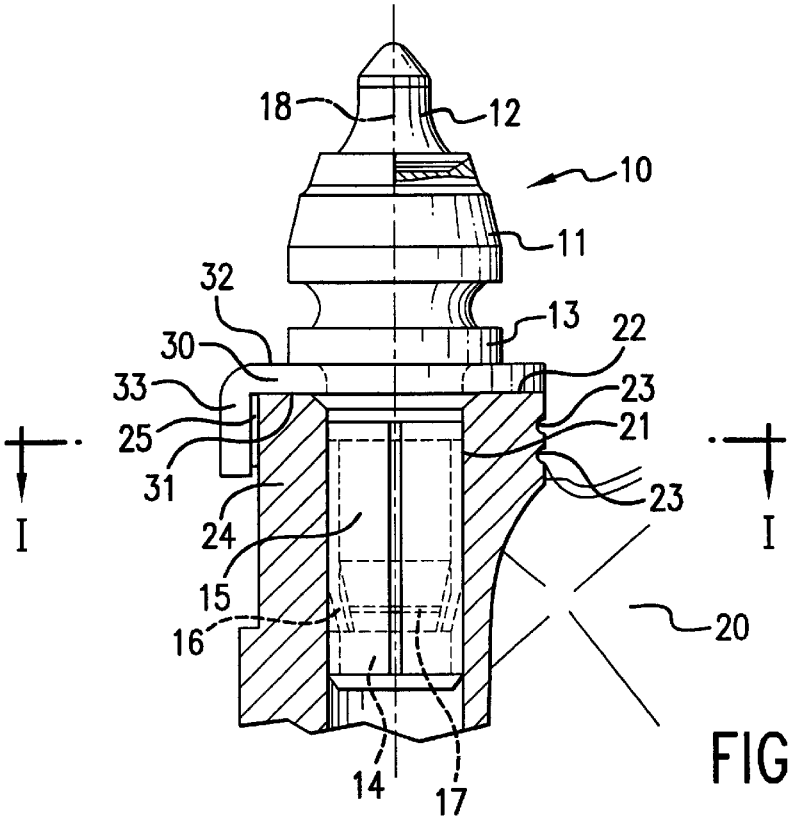
FIG. 1 shows a partial sectional side view of a tool with a round-shaft cutter and a cutter holder.

A tool with a round-shaft cutter 10 and a cutter holder 20 is shown in FIG. 1. The round-shaft cutter 10 has a cutter head 11 and a cutter shaft 14 formed on the cutter head 11. The cutter head 11 has a soldered-in hard alloy cutter tip 12 in a front receiver. The cutter head 11 has a collar 13 in a transition area toward the cutter shaft 14. In the area of its free end, the cutter shaft 14 has a circumferential groove 17. Holding elements 16 of a clamping element 15 engage the circumferential groove 17. The clamping element 15 is embodied as a longitudinally slit clamping sleeve, which encloses the cutter shaft 14. The holding elements 16 are punched out of the clamping sleeve and are bent in a direction toward the cutter shaft 14, so that they project into the groove 17.

A wear-protection disk 30 is pulled on the cutter shaft 14. For this purpose the wear-protection disk 30 has a central opening. The cutter head 11 is placed with an underside of the collar 13 on an upper surface 32 of the wear-protection disk 30. The wear-protection disk 30 has an opposite surface 31 on its underside, which is seated on a support surface 22 of the cutter holder 20.

The cutter holder 20 has a receiver 21, which is embodied as a bore and passes through a holding projection 24. The holding projection 24 is connected in one piece with the base body of the cutter holder 20. The holding projection 24 has a cylindrical protrusion, which bears the support surface 22. The protrusion has two circumferential grooves on its exterior circumference, which are used as wear markings 23. The receiver 21 transitions into the support surface 22 via an insertion section. The support surface 22 extends vertically relative to the center longitudinal axis 18 of the receiver 21.

Figure 1A:
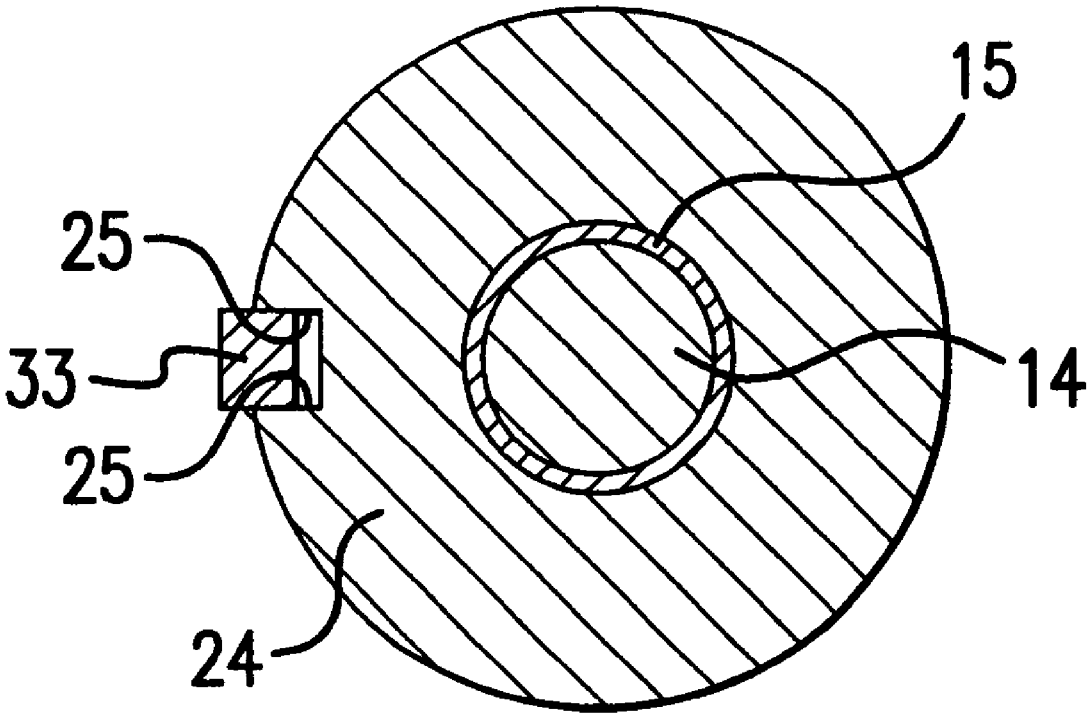
FIG. 1A shows a sectional view taken along line I—I, as shown in FIG. 1.

A tab 33 is used to fix the wear-protection disk 30 on the cutter holder 20 in a manner resisting its relative rotation. The tab 33 is formed as one piece on the wear-protection disk 30 and is bent at right angles, as shown in FIG. 1, with respect to it in the direction of the cutter holder 20. As shown in FIGS. 1 and 1A, the tab 33 rests against a tangential flattened and indented place 25 of the protrusion of the holding projection 24 A fixation against relative rotation is formed by means of the flattened place 25 and the tab 33 which prevents the wear-protection disk 30 from rotating in the circumferential direction when the tool is operated.

Figure 2:
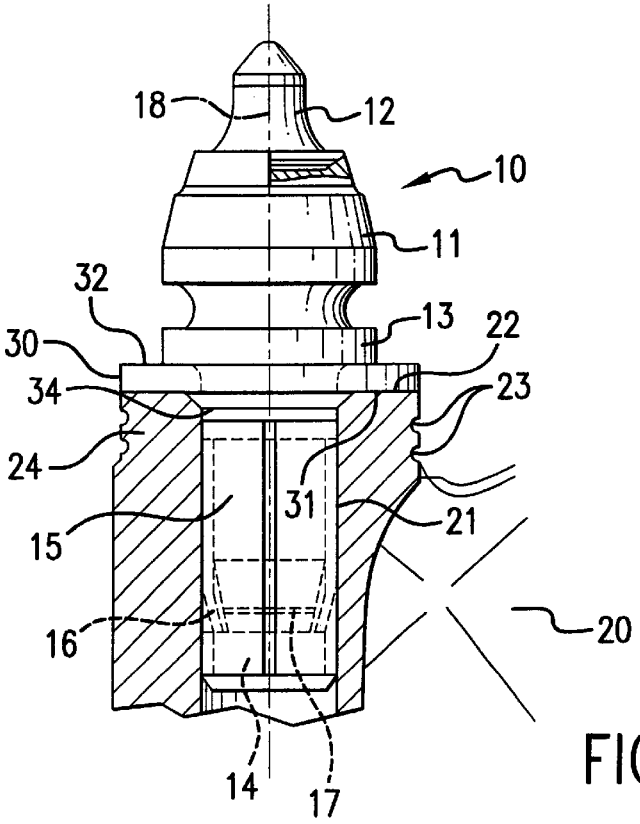
FIG. 2 shows a partial sectional side view of an embodiment changed with respect to FIG. 1, of a tool with a round-shaft cutter and a cutter holder.

A further embodiment of this invention is shown in FIG. 2. The construction of the round-shaft cutter 10 and of the tool holder 20 essentially correspond to the representation shown in FIG. 1. A difference results from the design of the device for fixation against relative rotation. On its opposite surface 31 the wear-protection disk 30 has a stop, which extends around the opening in the wear-protection disk 30. On its side facing away from the opposite surface 31, the stop is connected with the clamping sleeve by means of a connecting element 34 designed as a soldering. Since the clamping sleeve is clamped, fixed against relative rotation, in the receiver 21, the wear-protection disk 30 is also fastened on the support surface 32, fixed against relative rotation.

What is claimed is:

1. In a tool for at least one of a coal cutting machine, a mining machine and a road cutting machine, having a round-shaft cutter with a cutter head and a cutter shaft, wherein a wear-protection disk is pushed on the cutter shaft, on an upper side of the cutter shaft the cutter head rests, the cutter shaft is inserted into and captively held within a receiver of a cutter holder, an opposite side of the wear-protection disk is supported on a support surface of the cutter holder, and the wear-protection disk is maintained on the cutter holder and fixed against relative rotation by at least one holding element, the improvement comprising:

the wear-protection disk (30) forming a tab (33) designed as a holding element and bent at a right angle in a direction toward the cutter holder (20), and the tab (33) interlockingly fixed in place in a circumferential direction of the wear-protection disk (30) on a stop of the cutter holder (20);

the receiver (21) cut into a holding projection (24) of the cutter holder (20), the holding projection (24) having a protrusion bearing the support surface (22), the support surface (22) extending to radially outwardly dimension limits of the protrusion, and the wear-protection disk (30) covering the entire support surface (22); and the protrusion of the holding projection (24) being cylindrical and symmetrical with respect to a center longitudinal axis (18) of the receiver (21), and the protrusion having at least one tangential flattened and indented place (25) forming the stop against which the tab (33) rests.

* * * * *